US011154829B2

(12) United States Patent
Pfeiler et al.

(10) Patent No.: US 11,154,829 B2
(45) Date of Patent: Oct. 26, 2021

(54) METHOD AND METERING DEVICE FOR METERING A LIQUID OR PASTY PRODUCT IN A PRESSURE-REGULATED MANNER

(71) Applicant: VISCOTEC PUMPEN-U. DOSIERTECHNIK GMBH, Töging a. Inn (DE)

(72) Inventors: Gerald Pfeiler, Kennesaw, GA (US); Justin Kyle Brown, Kennesaw, GA (US); Georg Senftl, Töging a. Inn (DE)

(73) Assignee: VISCOTEC PUMPEN-U. DOSIERTECHNIK GMBH, Töging A. Inn (DE)

( * ) Notice: Subject to any disclaimer, the term of this patent is extended or adjusted under 35 U.S.C. 154(b) by 399 days.

(21) Appl. No.: 16/088,010

(22) PCT Filed: Feb. 7, 2017

(86) PCT No.: PCT/EP2017/052577
§ 371 (c)(1),
(2) Date: Sep. 24, 2018

(87) PCT Pub. No.: WO2017/167478
PCT Pub. Date: Oct. 5, 2017

(65) Prior Publication Data

US 2019/0105621 A1 Apr. 11, 2019

(30) Foreign Application Priority Data

Apr. 1, 2016 (EP) ..... 16163483

(51) Int. Cl.
*B01F 15/00* (2006.01)
*B01F 5/06* (2006.01)
(Continued)

(52) U.S. Cl.
CPC ..... *B01F 15/00357* (2013.01); *B01F 3/088* (2013.01); *B01F 5/0609* (2013.01);
(Continued)

(58) Field of Classification Search
CPC ..... B05C 11/1013; B01F 15/00357
See application file for complete search history.

(56) References Cited

U.S. PATENT DOCUMENTS 10,248,139 B2 * 4/2019 Surenbrock ..... F04C 14/28
2007/0062642 A1 3/2007 Reck et al.

FOREIGN PATENT DOCUMENTS

DE 3912920 A1 12/1989
DE 3913000 A1 * 12/1989 ..... B05C 5/001
(Continued)

OTHER PUBLICATIONS

Translation of Bauer, R. (DE 3913000), published Dec. 7, 1989. Translation retrieved Feb. 2021 (Year: 1989).*
(Continued)

*Primary Examiner* — Elizabeth Insler
(74) *Attorney, Agent, or Firm* — Greer, Burns & Crain, Ltd

(57) ABSTRACT

A method for metering a liquid or pasty product in a pressure-regulated manner, has the following steps: metering the product into a mixing chamber using a metering pump; ascertaining a product pressure of the product according to the mixing chamber; ascertaining a deviation of the product pressure from a specified target pressure; and opening or closing a pressure regulating valve provided on an outlet nozzle of the mixing chamber based on the pressure in order to equalize the product pressure and the target pressure, wherein the product pressure is reduced when the pressure regulating valve is opened and increased when the pressure regulating valve is closed.

7 Claims, 7 Drawing Sheets

(51) Int. Cl.

| | |
|---|---|
| ***B01F 15/02*** | (2006.01) |
| ***B01F 3/08*** | (2006.01) |
| ***B05C 11/10*** | (2006.01) |
| ***B05C 5/02*** | (2006.01) |
| ***B01F 7/00*** | (2006.01) |
| *B05B 9/04* | (2006.01) |
| *B05B 12/14* | (2006.01) |

(52) U.S. Cl.
CPC .... *B01F 7/00908* (2013.01); *B01F 15/00162* (2013.01); *B01F 15/0243* (2013.01); *B05C 5/0225* (2013.01); *B05C 11/1013* (2013.01); *B05C 11/1036* (2013.01); *B05B 9/0416* (2013.01); *B05B 12/1436* (2013.01)

(56) References Cited

FOREIGN PATENT DOCUMENTS

| | | | |
|---|---|---|---|
| DE | 3913000 | A1 | 12/1989 |
| DE | 20318476 | U1 | 4/2004 |
| EP | 1691076 | A1 | 8/2006 |
| EP | 2790080 | A1 | 10/2014 |

OTHER PUBLICATIONS

International Search Report from International Patent Application No. PCT/EP2017/052577, dated May 2, 2017.

* cited by examiner

METHOD AND METERING DEVICE FOR METERING A LIQUID OR PASTY PRODUCT IN A PRESSURE-REGULATED MANNER

BACKGROUND

The present invention relates to a method and to a metering device for metering a liquid or pasty product in a pressure-regulated manner.

Metering pumps having downstream integrated static or dynamic mixers are used for the application of single-component or multi-component adhesives and sealants or even paints in automation technology. These here are, for example, piston or gear metering units or metering units according to the eccentric screw principle which units by means of a control unit implement the precise quantity or the volume and the mixing ratio at the entry of the mixer. Static mixing is performed by way of so-called static mixers having mixing helices, wherein the two components are mixed by being thrown over one another multiple times. Pressure losses which have to be overcome by the metering pumps are created herein on account of the friction in the static or dynamic mixer. Depending on the embodiment, shut-off valves can be disposed both at the entry as well as at the exit of the mixer so as to interrupt the product flow when starting and stopping the metering and so as to thus prevent any subsequent dripping or pressurization by the successive product. The quantity, or the volume, respectively, per component can be influenced by various factors during the metering procedure. Said factors are inter alia the back pressure in the static mixer, the viscosity of the components, the compressibility, and other rheological properties such as, for example, the yield point of the components. The compressibility of adhesives can assume a significant degree herein, for example by way of inclusions of air or gas. By virtue of the volumetric variation and the variation in the pressure states in the dynamic as well as in the static state, the accuracy of the volume, or of the quantity, respectively is not always guaranteed in particular in the case of compressible components, such that partial errors in the mixing ratio as well as in the total quantity can arise.

SUMMARY

Against this background an object of the present invention lies in providing an improved method for metering a liquid or pasty product.

Accordingly, a method for metering a liquid or pasty product in a pressure-regulated manner is proposed. The method comprises the following steps: metered feeding of the product with the aid of a metering pump into a mixing chamber; determining a product pressure of the product after the mixing chamber; determining a deviation of the product pressure from a predetermined nominal pressure, and opening or closing in a pressure-dependent manner a pressure-regulating valve that is provided on an exit nozzle of the mixing chamber, so as to align the product pressure with the nominal pressure, wherein the product pressure is reduced when opening the pressure-regulating valve and is increased when closing the pressure-regulating valve.

The pressure-regulating valve herein is in particular regulated in such a manner, preferably at all times regulated in such a manner, that the product pressure is aligned with the nominal pressure.

The method is carried out in particular with the aid of a metering device that is yet to be described hereunder. The product can have a plurality of components. For example, the product can have two components, wherein one metering pump is assigned to each product. The method in this instance can comprise a step of metered feeding a first component and a second component into the mixing chamber. However, the product can also have only one component. The product is preferably continuously fed in a metered manner into the mixing chamber. This means that the metering pump feeds the product in a metered manner into the mixing chamber during the entire method. The product can be, for example, an adhesive or a sealant, water, an aqueous solution, a paint, a suspension, a viscous raw material, an emulsion, or a fat. For example, the product can be a bi-component, or multi-component adhesive. Paste, or a pasty product, is to be understood as a mixture of a solid and a liquid, in particular a suspension, having a high content of solids. For example, the product can have a content of fillers, for example so-called micro balloons. The product pressure is in particular raised to at least the nominal pressure or beyond the nominal pressure. It is guaranteed with the aid of the method that the product is at all times maintained at the nominal pressure. On account thereof, metering inaccuracies which could be created by pressure losses that are created in the mixing chamber can prevented. That the product pressure is aligned with the nominal pressure is to be understood such that the product pressure with the aid of the pressure-regulating valve is raised to the nominal pressure, or that the product pressure with the aid of the pressure-regulating valve is lowered to the nominal pressure. The product pressure herein is preferably maintained in a specific pressure range which corresponds to the nominal pressure plus/minus a predefined tolerance.

The pressure-regulating valve is in particular not an open/shut valve which can be switched to only two switched positions, specifically selectively to an open position or to a closed position. An open/shut valve of this type can also be referred to as a shut-off valve or a stop valve. A regulating valve or a pressure-regulating valve is presently to be understood as a valve which is movable in a stepless manner to an arbitrary, in particular infinite, number of intermediate positions between an open position, meaning a minimum product pressure, and a closed position, meaning a maximum product pressure. On account thereof, any arbitrary product pressure between the minimum product pressure and the maximum product pressure can be set in a stepless manner. To this end, the pressure-regulating valve preferably has a valve plunger or a valve member which with the aid of a drive element is relocatable in particular in a linear manner. The valve member can be, for example, needle-shaped (needle valve) or spherical (ball valve). The drive element is preferably an electric motor or an electric motor having an adjustment spindle as the actuator. On account thereof, the valve member can be moved to any arbitrary position between the open position and the closed position. The pressure-regulating valve is thus actuatable or regulatable in a stepless manner. The open position can also be referred to as the open or opened state, and the closed position can also be referred to as the closed or closed-off state.

According to one further embodiment, the product is compressible, wherein the product as from the nominal pressure is incompressible.

Compressible can be understood to mean that the product is almost or substantially compressible. Incompressible can furthermore be understood to mean that the product is almost or substantially incompressible. For example, the product when impinged by pressure beyond the nominal pressure can be slightly compressible again. In particular, the product can be further compressible at a pressure that is substantially higher than the nominal pressure. For example, the product can display a compressibility (volumetric variation) of approx. 20% at a pressure of approx. 15 bar. In a range from 15 bar to 30 bar the compressibility (volumetric variation) can be significantly almost incompressible in relation to a lower pressure range from 0 bar to 15 bar.

A fluid, the density of which does not depend on pressure, is called incompressible, as opposed to compressible fluids. A property of fluids is the compressibility which describes the variation in the density of a fluid in the event of a variation in pressure and the property of the volumetric variation in the event of a variation in temperature. The compressibility of a fluid is the decisive criterion in terms of differentiating between a gas (compressible) and a liquid (almost incompressible). The terms hydraulic (almost incompressible fluid such as liquids, mostly oil) and pneumatic (compressible fluids such as gases, mostly air) are understood to be technologies which implement and control "movements of force" by way of fluids. Furthermore, a differentiation is made between ideal and real fluids.

Specifically in the case of compressible products, dissimilar flows and volumes, or masses, respectively, can arise above all at the beginning and at the end of a metering procedure, the determination of said flows and volumes, or masses, respectively, is not able to be determined by a back pressure, for example in the mixing chamber, that is generated by flow resistances. Since the compressibility of the product becomes almost zero as from the nominal pressure, this effect can be minimized in that the product pressure is always maintained in a pressure window that is greater than the nominal pressure. It can furthermore be prevented with the aid of the method that sensitive fillers, for example micro balloons, which could burst as from a specific product pressure, are damaged. To this end, the nominal pressure is limited to a maximum pressure which is only so high that any damage to the fillers is prevented.

According to one further embodiment, at least two dissimilar components of the product are fed in a metered manner into the mixing chamber.

The product can also have more than two, for example three or four, components. The product can be a bi-component adhesive, for example. One of the components herein can be filled with a filler, and the other component can be non-filled.

According to one further embodiment, the at least two components in the mixing chamber are mixed with one another with the aid of a static mixer and/or of a dynamic mixer.

A static mixer is to be understood to be a mixer which does not have any movable components. For example, mixing elements or mixing helices which are specified for mutually mixing the two components by the latter being thrown over one another multiple times can be disposed in the mixing chamber. As opposed thereto, a dynamic mixer has a movable mixing element. The mixing element can be rotatingly moved by way of a drive shaft, for example.

According to one further embodiment, the product pressure is maintained in a predetermined pressure window.

It is guaranteed on account thereof that the product is always maintained at the nominal pressure, and damage to fillers of the product can simultaneously be prevented on account thereof, as has already been mentioned above.

According to one further embodiment, the method furthermore comprises a calibration step in which an entry of the mixing chamber is closed and the product is directed to a calibration exit, wherein a product pressure of the product ahead of the calibration exit is determined, wherein a deviation of the product pressure from a predetermined nominal pressure is determined, wherein a pressure valve that is provided on the calibration exit is opened or closed in a pressure-dependent manner, so as to align the product pressure with the nominal pressure, and wherein the product pressure is reduced when opening the pressure-regulating valve and is increased when closing the pressure-regulating valve.

In particular, a first duct for a first component and a second duct for a second component are provided at the entry of the mixing chamber. The two ducts can in each case be closed and opened by shut-off valves that are assigned thereto. As is the case in the regulating of the pressure of the metering flow, a stable pressure state which corresponds to the same pressure state as in the metering can be achieved for the calibration step. However, since the product flow per component in this calibration step is metered individually from the calibration opening that is assigned to the respective component, a calibration of each individual component under pressurization can be performed in a very simple manner. To this end, the quantity of the respective component is measured and can then be used as a measured value of a calibrating function of the metering device.

According to one further embodiment, the same product pressure as in the mixing chamber is achieved in the calibration step.

On account thereof, the values that are determined when calibrating can be transferred in a simple manner to the metering procedure of the product.

According to one further embodiment, the calibration step is carried out separately for dissimilar components of the product.

For example, the calibration step for the first component of the product and that for the second component of the product can be carried out separately. The calibration step can also be carried out when the product has only one component.

Furthermore, a metering device for metering a liquid or pasty product in a pressure-regulated manner is proposed. The metering device has a mixing chamber; at least one metering pump, disposed upstream of the mixing chamber, for feeding in a metered manner the product into the mixing chamber; a pressure sensor for determining a product pressure of the product in the mixing chamber; a pressure-regulating valve for opening or closing in a pressure-dependent manner an exit nozzle of the mixing chamber; and a control installation which is specified for actuating in a pressure-dependent manner the pressure-regulating valve so as to align the product pressure with a nominal pressure.

The metering pump can be an eccentric screw pump, a gear pump, a piston metering unit, or the like. The metering pump is preferably an eccentric screw pump. An eccentric screw pump preferably comprises a stator, received in a pump housing, which has an elastically deformable elastomer part having a central breach. The breach preferably comprises an internal contour in the shape of a screw or a worm. A rotatable rotor which comprises an external contour in the shape of a screw or a worm that corresponds to that of the elastomer part is preferably provided in the stator. The rotor can be driven by means of a drive shaft that is mounted in a bearing housing of the eccentric screw pump. A drive installation, in particular an electric motor, is preferably connectable to the drive shaft. The drive shaft can be fixedly connected to the rotor with the aid of a flexible shaft, an articulation, or a flex-shaft. When rotating the rotor, on account of the interaction with the elastomer part of the stator, the product or the component, respectively, in a longitudinal direction of the eccentric screw pump is conveyed away from the drive shaft according to the principle of the endless piston. The mixing chamber is in particular provided in a tubular or rectangular mixing block. A pipeline or a hose can be disposed between the mixing chamber and the at least one metering pump, for example, so that the mixing chamber can be disposed so as to be remote from the metering pump. The pressure sensor can be provided directly on the mixing chamber or on a product diversion block.

According to one embodiment, the mixing chamber has a static mixer and/or a dynamic mixer.

A static mixer is preferably provided in the mixing chamber. On account thereof the metering device is particularly low-maintenance. Furthermore, a static mixer is more cost-effective than a dynamic mixer.

According to one further embodiment, the pressure-regulating valves is a needle valve.

A needle valve in particular has a needle-shaped valve member. A needle valve which ideally without a dead space can function directly as the metering tip is preferably used. Alternatively, the pressure-regulating valve is a ball valve having a spherical valve member. The pressure-regulating valve in particular has a drive element, preferably a spindle drive, or an electric motor having an adjustment spindle as an actuator, and a needle-shaped valve member which is disposed in a bore of a nozzle tube.

According to one further embodiment, a product diversion block for diverting the product is provided on the mixing chamber, wherein the pressure sensor and a drive element of the pressure-regulating valve are provided on the product diversion block.

The product diversion block is preferably specified for twice deflecting the product by an angle of 90°. The product diversion block is dispensable. On account of the diversion of the product in the product diversion block it can be achieved that the valve member is axially relocatable in a flow direction of the product so as to open and close the pressure-regulating valve.

According to one further embodiment, the metering device furthermore comprises a throughflow block, disposed between the at least one metering pump and the mixing chamber, having a duct through which the product is able to be directed; a pressure sensor for determining a product pressure of the product in the duct; and a shut-off valve for closing the duct ahead of the mixing chamber.

The throughflow block can have a mixing head block and a throughflow shut-off block, wherein the mixing head block is disposed between the throughflow shut-off block and the metering pump. The duct preferably penetrates both the throughflow shut-off block as well as the mixing head block. In particular, a first duct for the first component and a second duct, fluidically separated from the first duct, for the second component can be provided in the throughflow block. A dedicated pressure sensor can be assigned to each of the ducts. Furthermore, one shut-off valve can be assigned to each of the ducts. The entry to the mixing chamber is capable of being closed and opened with the aid of the shut-off valves.

According to one further embodiment, the metering device furthermore comprises a calibration block having a calibration exit and a pressure-regulating valve for opening or closing in a pressure-dependent manner the calibration exit, wherein the control installation is specified for actuating in a pressure-dependent manner the pressure-regulating valve so as to align the product pressure with a nominal pressure in the event of a closed shut-off valve.

The calibration block is preferably fastened to the throughflow block. The calibration block preferably has a first calibration exit and a second calibration exit, wherein a first pressure-regulating valve is assigned to the first calibration exit, and a second pressure-regulating valve is assigned to the second calibration exit. The calibration exits are in each case connected to the respectively assigned ducts in the throughflow block by way of a bore. The control installation is preferably specified for actuating the pressure-regulating valves and the shut-off valves in each case so as to depend on determined measured values of the respectively assigned pressure sensors. The control installation can have a computer program having a regulating algorithm, preferably a PID regulator.

According to one further embodiment, the metering device has a first metering pump for metering a first component of the product, and a second metering pump for metering a second component of the product.

The number of metering pumps is arbitrary. For example, the metering device can also comprise three or more metering pumps. The metering pumps can be fastened to the throughflow block. Alternatively, the metering pumps and the throughflow block can be coupled by means of a connecting line.

Further potential implementations of the method and/or of the metering device also comprise combinations not explicitly set forth of features or embodiments which have been described above or will be described hereunder with reference to the exemplary embodiments. A person skilled in the art herein will also add individual aspects as improvements or additions to the respective basic form of the method and/or of the metering device.

Further advantageous design embodiments and aspects of the method and/or of the metering device are the subject matter of the dependent claims and of the exemplary embodiments of the method and/or of the metering device that will be described hereunder. The method and/or the metering device will furthermore be explained in more detail by means of preferred embodiments with reference to the appended figures in which:

DETAILED DESCRIPTION

Identical or functionally identical elements have been provided with the same reference signs in the figures unless otherwise stated.

Figure 1:
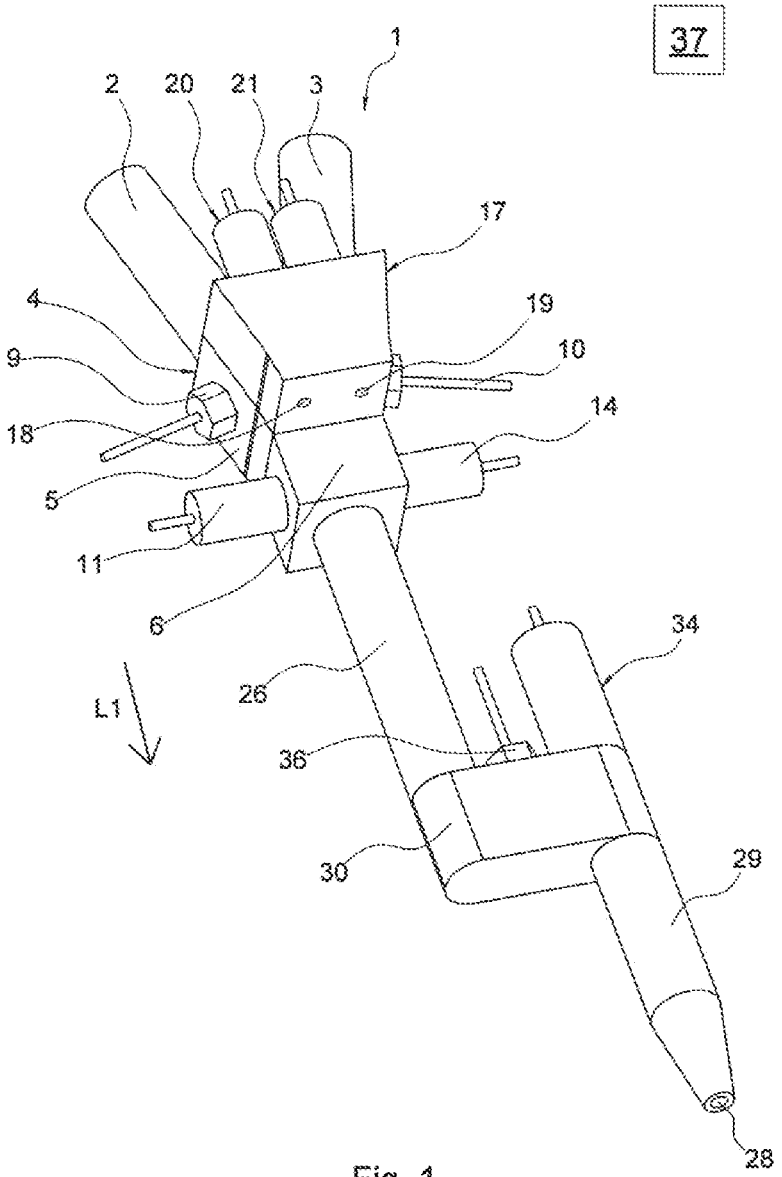
FIG. 1 shows a schematic perspective view of an embodiment of a metering device.
Figure 2:
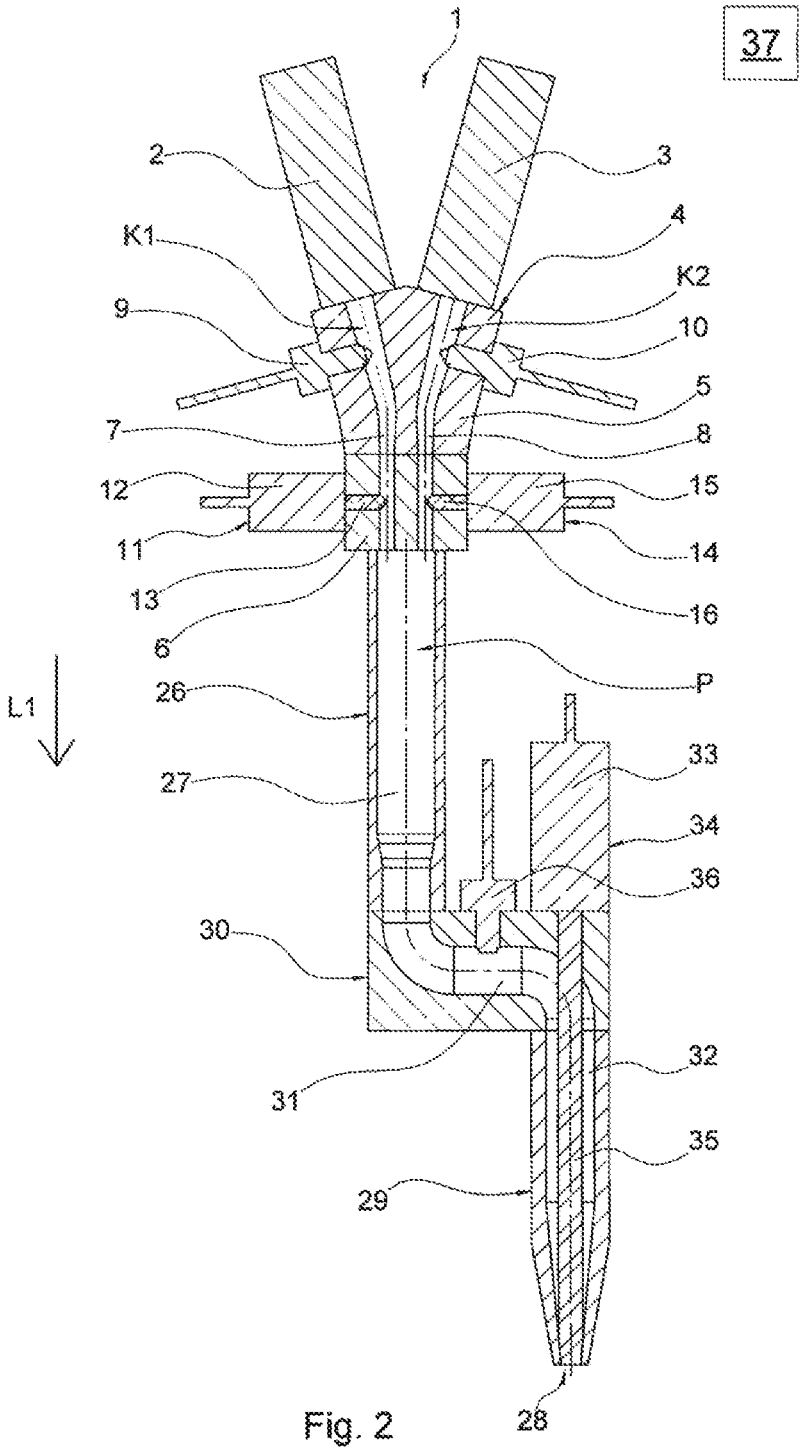
FIG. 2 shows a schematic sectional view of the metering device according to FIG. 1.
Figure 3:
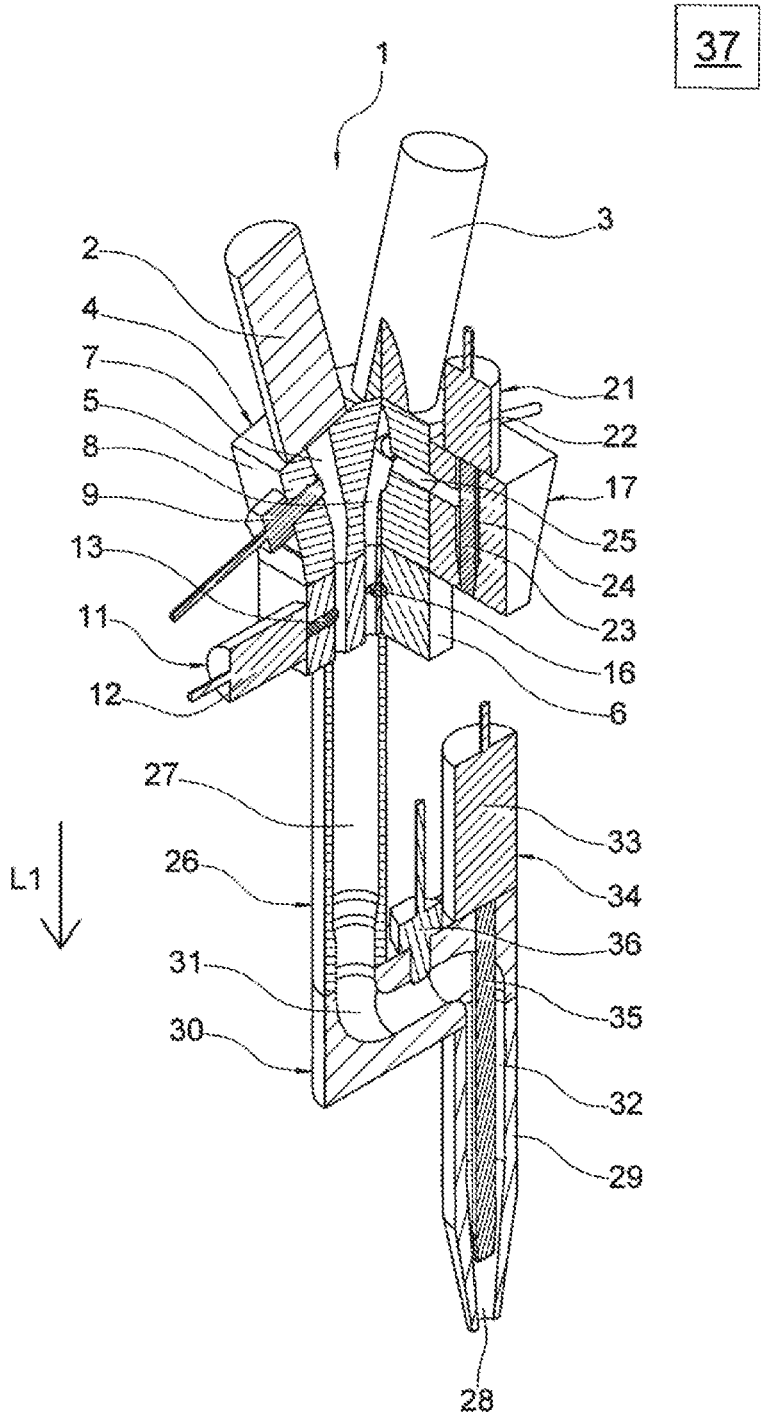
FIG. 3 shows a schematic perspective partial sectional view of the metering device according to FIG. 1.

FIG. 1 shows a schematic perspective view of an embodiment of a metering device 1 for metering in a pressure-regulated manner a liquid or pasty product P. FIG. 2 shows a schematic sectional view of the metering device 1, and FIG. 3 shows a schematic perspective partial sectional view of the metering device 1. Reference hereunder is made simultaneously to FIGS. 1 to 3.

The product can be, for example, an adhesive or a sealant, water, an aqueous solution, a paint, a suspension, a viscous raw material, an emulsion, or a fat. The product P can have one or more than one component K1, K2. For example, the product P can be a bi-component adhesive. The product can be filled with fillers such as micro balloons, for example. Micro balloons are hollow glass spheres which are used, for example, as fillers for epoxy and polyester resin systems. Micro balloons of this type can have, for example, a bulk density of 140 to 150 g/l, a specific weight of 0.26 g/cm$^3$, a grain size distribution of 50 μm, and a maximum particle size of 200 μm. A pasty product or a paste is understood to be a mixture of a solid and a liquid, in particular a suspension, having a high content of solids.

The metering device 1 comprises at least one metering pump 2, 3. The metering device 1, as is shown in FIGS. 1 to 3, can have two metering pumps 2, 3, in particular one first metering pump 2 and one second metering pump 3, or an arbitrary number of metering pumps, for example three metering pumps. The metering pumps 2, 3 can be, for example, eccentric screw pumps, gear pumps, piston metering units, or the like. The metering pumps 2, 3 are preferably configured as eccentric screw pumps.

An eccentric screw pump preferably comprises a stator, received in a pump housing, which has an elastically deformable elastomer part having a central breach. The breach preferably comprises an internal contour in the shape of a screw or a worm. A rotatable rotor which comprises an external contour in the shape of a screw or a worm that corresponds to the elastomer part is preferably provided in the stator. The rotor can be driven by means of a drive shaft by a drive element, in particular an electric motor. The drive shaft can be fixedly connected to the rotor with the aid of a flexible shaft or a flex-shaft or a universal-joint shaft. When rotating the rotor, on account of the interaction with the elastomer part of the stator, the product P or the component K1, K2, respectively, in a longitudinal direction of the eccentric screw pump is conveyed away from the drive shaft according to the principle of the endless piston. The conveyed volume herein depends on the rotational speed, the size, the pitch, and the geometry of the rotor.

The first metering pump 2 and the second metering pump 3 are assembled on a throughflow head or a throughflow block 4. The metering pumps 2, 3 herein are disposed in a V-shaped manner or in parallel. The throughflow block 4 can be made from a steel or an aluminum material, for example. The throughflow block 4 can be configured in two parts and have a mixing head block 5, to which the metering pumps 2, 3 are fastened, and a throughflow shut-off block 6. The mixing head block 5 herein is disposed between the throughflow shut-off block 6 and the metering pumps 2, 3.

The throughflow block 4 comprises a first duct 7 that penetrates the mixing head block 5 and the throughflow shut-off block 6, the first component K1 being capable of being directed through said first duct 7, and a second duct 8 that is at least in part disposed so as to be parallel with the first duct 7, the second component K2 being capable of being directed through said second duct 8. The throughflow block 4 furthermore comprises a first pressure sensor 9 for determining a pressure of the first component K1 in the first duct 7, and a second pressure sensor 10 for determining a pressure of the second component K2 in the second duct 8.

The throughflow block 4 furthermore comprises a first shut-off valve 11 for closing the first duct 7 downstream of the first pressure sensor 9. The first shut-off valve 11 comprises a drive element 12, for instance an electric motor, as well as a valve plunger or a valve member 13 which for closing the first duct 7 is relocatable into the latter and for opening the first duct 7 is relocatable out of the latter again. Furthermore, the throughflow block 4 comprises a second shut-off valve 14 for closing the second duct 8 downstream of the second pressure sensor 10. The second shut-off valve 14 likewise comprises a drive element 15 and a valve plunger or a valve member 16 which for closing and opening the second duct 8 is relocatable into the second duct 8 and relocatable out of the latter again.

The metering device 1 furthermore comprises a calibration block 17 that is fastened to the mixing head block 5. The calibration block 17 can be screw-fitted to the mixing head block 5, for example. The calibration block 17 comprises a first calibration exit 18 and a second calibration exit 19. Furthermore, the calibration block 17 comprises a first pressure-regulating valve 20 for opening or closing in a pressure-dependent manner the first calibration exit 18, and a second pressure-regulating valve 21 for opening or closing in a pressure-dependent manner the second calibration exit 19.

The second pressure-regulating valve 21 comprises a drive element 22 and a valve plunger or a valve member 23 which with the aid of the drive element 22 is relocatable in a linear manner in a longitudinal direction L1 of the metering device 1. The drive element 22 is preferably an electric motor having an adjustment spindle as an actuator. The second calibration exit 19 can be opened or closed with the aid of the valve member 23. The valve member 23 is preferably needle-shaped. The second pressure-regulating valve 21 is in particular a needle valve.

The valve member 23 of the second pressure-regulating valve 21 is disposed in a bore 24 that is provided in the calibration block 17. The bore 24 can run so as to be parallel with the second duct 8. The second duct 8 is fluidically connected to the bore 24 by way of a bore 25 that is guided through the mixing head block 5 and the calibration block 17. The second calibration exit 19 is capable of being closed and opened with the aid of the second pressure-regulating valve 21.

The first pressure-regulating valve 20 likewise has a drive element 22 of this type as well as a needle-shaped valve member 23. The first calibration exit 18 is capable of being closed and opened with the aid of the first pressure-regulating valve 20. The valve member 23 of the first pressure-regulating valve 20 is provided in a bore 24 that is disposed so as to be parallel with the first duct 7 and by way of a further bore 25 is fluidically connected to the first duct 7. The bores 24, 25 assigned to the first calibration exit 18, as well as the valve member 23 of the first pressure-regulating valve 20, are not shown in FIGS. 1 to 3.

The metering device 1 comprises a mixing block 26 which on the front side is fastened to the throughflow shut-off block 6. The mixing block 26 can be fastened directly to the throughflow shut-off block 6, or a pipeline or a hose can be provided between the throughflow shut-off block 6 and the mixing block 26. The mixing block 26 is tubular and encloses a cylindrical mixing chamber 27 in which the first components K1 and the second component K2 are mixed. To this end, a static mixer and/or a dynamic mixer can be provided in the mixing chamber 27.

A static mixer is to be understood to be a mixer which does not have any movable parts. A static mixer of this type in particular has mixing helices or mixing members, wherein the two components K1, K2 when the latter are being conveyed through the mixing chamber 27 are mixed by being thrown on top of one another multiple times. As opposed thereto, a dynamic mixer has one or a plurality of movable mixing elements, for example a rotatable mixing element. The components K1, K2 are mixed to the product P in the mixing chamber 27. In the case of the product P not having multiple components, the product P is fed in a metered manner by the metering pump 2, 3, in this case only by one metering pump 2, 3, into the mixing chamber 27 and mixed therein.

The mixing block 26 has an exit nozzle 28 which does not mandatorily have to be provided directly on the mixing block 26. The exit nozzle 28 is provided on a sharply tapered nozzle tube 29. A product diversion block 30 is provided between the nozzle tube 29 and the mixing block 26. The product P can be diverted with the aid of the product diversion block 30. The product diversion block 30 is in particular specified for twice diverting the product by an angle of 90°. To this end, a tortuous duct 31 which fluidically connects the mixing chamber 27 to a duct 32 that is provided in the nozzle tube 29 is provided in the product, diversion block 30. The ducts 31, 32 can be part of the mixing chamber 27.

A drive element 33 of a further, in particular of a third, pressure-regulating valve 34 is provided on the product diversion block 30. The drive element 33 is preferably an electric motor having an adjustment spindle as an actuator. The exit nozzle 28 can be opened or closed in a pressure-dependent manner with the aid of the pressure-regulating valve 34. To this end, the pressure-regulating valve 34 has a valve plunger or a valve member 35 that is provided in the duct 32 of the nozzle tube 29. The valve member 35 is relocatable in a linear manner in particular in the longitudinal direction L1 in the duct 32. The pressure-regulating valve 34 is in particular a needle valve.

The pressure-regulating valves 20, 21, 34 are in particular not configured as open/shut valves. An open/shut valve can be switched to only two switched positions, specifically selectively to an open position or to a closed position. An open/shut valve of this type can also be referred to as a shut-off valve or a stop valve. A regulating valve or a pressure-regulating valve is presently to be understood as a valve which is movable in a stepless manner to an arbitrary, in particular infinite, number of intermediate positions between an open position, meaning a minimum product pressure, and a closed position, meaning a maximum product pressure. On account thereof, any arbitrary product pressure between the minimum product pressure and the maximum product pressure can be set. To this end, the respective pressure-regulating valve 20, 21, 34 preferably has in each case the valve member 23, 35 already mentioned above which with the aid of the respective drive element 22, 33 is relocatable in particular in a linear manner. The valve member 22, 33 herein can be, for example, needle-shaped (needle valve) or spherical (ball valve). The drive element 22, 33 is preferably in each case an electric motor or an electric motor having an adjustment spindle as an actuator. On account thereof, the respective valve member 23, 35 can be moved to any arbitrary position between the open position and the closed position. The metering device 1 furthermore comprises a pressure sensor 36 for determining a product pressure of the product P after the mixing chamber 27. The pressure sensor 36 can be disposed directly on the mixing chamber 27 or, as is shown in FIGS. 1 to 3, on the product diversion block 30 and in particular in the duct 31 of the product diversion block 30.

The metering device 1 furthermore comprises a control installation 37 which is specified for detecting measured values of the pressure sensors 9, 10, 36 and for actuating the pressure-regulating valves 20, 21, 34 as well as the shut-off valves 11, 14. The control installation 37 is also specified for comparing the measured values that have been detected with the aid of the pressure sensors 9, 10, 36 with a nominal value.

The functionality of the metering device 1 will be explained hereunder with reference to FIGS. 4 to 8 which in each case show sectional detailed views of the metering device 1. The quantity, or the volume, respectively, per component K1, K2 during the metering procedure can be influenced by various factors. These can be inter alia the back pressure in the mixing chamber 27, the viscosity of the product P or of the components K1, K2, respectively, the compressibility of the product P or of the components K1, K2, respectively, and other rheological properties such as, the yield point, for example. The compressibility of the product P or of the 355 components K1, K2, respectively, herein can assume a significant degree on account of inclusions of air or gas, or by adding micro balloons.

By virtue of the volumetric variation and the variations in the pressure states in the dynamic as well as in the static state, the accuracy of the metered volume, or of the quantity, is not guaranteed in particular in the case of compressible components K1, K2, such that partial errors in the mixing ratio as well as in the total quantity can arise in order for this to be prevented, in the case of the metering device 1 the product P or the components K1, K2, respectively, are fed in a metered manner into the mixing chamber 27 with the aid of the respective metering pump 2, 3. The feeding in a metered manner herein can be performed in a continuous manner. This means that the metering pumps 2, 3 deliver a continuous volumetric flow. The shut-off valves 11, 14 in the normal operation of the metering device 1 are opened such that the ducts 7, 8 are fluidically connected to the mixing chamber 27. This means that the metering pumps 2, 3 convey into the mixing chamber 27.

The product pressure of the product P after the mixing chamber 27 is measured with the aid of the pressure sensor 36. With the aid of the control installation 37, this determined product pressure is compared with a predetermined nominal pressure, and the deviation of the product pressure from the nominal pressure is determined. The control installation 37 to this end can have a computer program having a regulating algorithm, preferably having a PID (proportional integral derivative) regulation. The nominal pressure herein is preferably so high that the product P is no longer compressible and in particular is almost or substantially no longer compressible. However, the product pressure is so minor that the product P is not damaged, for example so minor that the squashing of micro balloons that are contained in the product P is prevented. This means that the product pressure is maintained in a predetermined pressure window.

Figure 4:
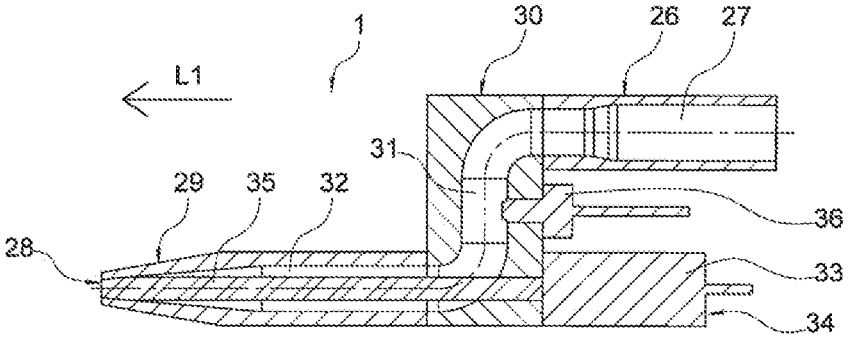
FIG. 4 shows a schematic partial sectional view of the metering device according to FIG. 1.
Figure 5:
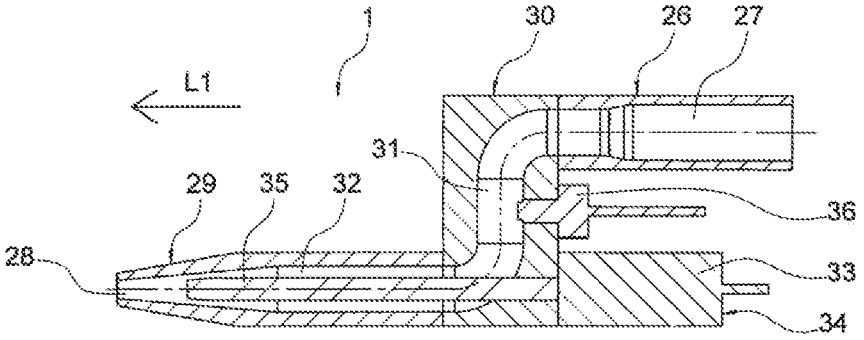
FIG. 5 shows a further schematic partial sectional view of the metering device according to FIG. 1.

The control installation 37 now actuates the pressure-regulating valve 34 such that the exit nozzle 28 is opened or closed in a pressure-dependent manner. Accordingly, the product pressure is lowered when the pressure-regulating valve 34 is opened, since the product P can exit through the exit nozzle 28. The product pressure on the mixing chamber 27 rises when the pressure-regulating valve 34 is closed, since the product P can no longer exit from the exit nozzle 28. To this end, FIG. 4 shows the pressure-regulating valve 34 in the closed state, and FIG. 5 shows the pressure-regulating valve 34 in the open state.

The product pressure of the product P during the entire metering procedure, both in the static as well as in the dynamic state, can thus be maintained so as to be constant with the aid of the metering device 1, so as to minimize inaccuracies in the metering, or to completely prevent the latter, respectively. Depending on the product pressure measured by the pressure sensor 36, a high pressurized state can be constantly maintained with the aid of the pressure-regulating valve 34 that is actuated by the control installation 37. This independently of whether the product P flows or does not flow, that is to say both in a static as well as in a dynamic state. The product pressure is thus also independent of the throughflow and of the back pressure through the static mixer in the mixing chamber 27 and through the exit nozzle 28.

Figure 6:
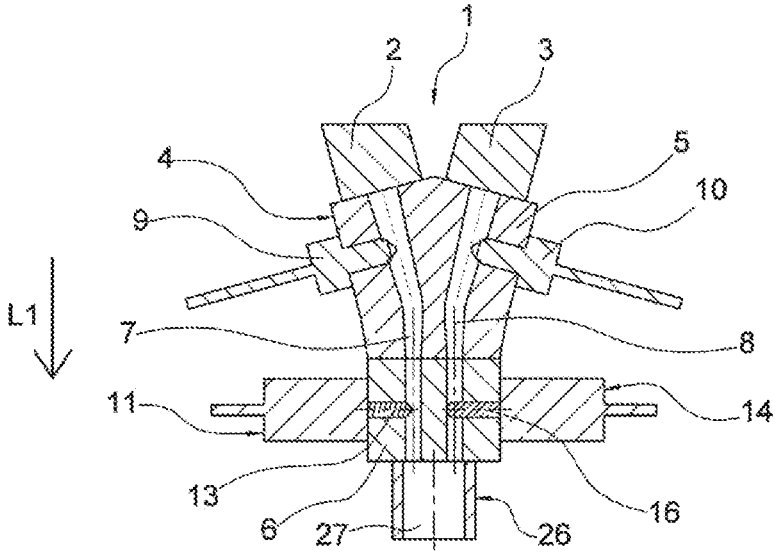
FIG. 6 shows a further schematic partial sectional view of the metering device according to FIG. 1.

Besides the regulating function of the product pressure, a calibration when under pressure can also be enabled. To this end, an entry of the mixing chamber 27 is closed with the aid of the shut-off valves 11, 14. The first shut-off valve 11 in FIG. 6 is opened, that is to say that the valve member 13 does not block the first duct 7, which is provided in the throughflow block 4. The second shut-off valve 14 is closed, that is to say that the valve member 16 is relocated into the second duct 8 so as to block the latter. As in the case of the pressure regulation of the volumetric flow of the product P, a stable pressurized state which preferably corresponds to the same pressurized state as when metering the product P is achieved by way of the pressure sensor 10, the control installation 37, and the pressure-regulating valve 21.

Figure 7:
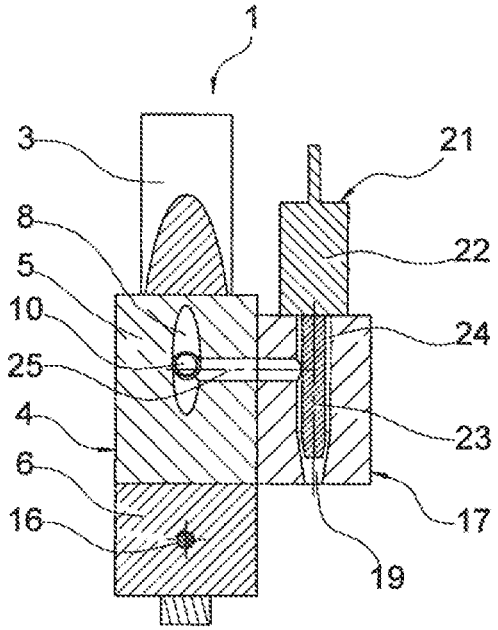
FIG. 7 shows a further schematic partial sectional view of the metering device according to FIG. 1.
Figure 8:
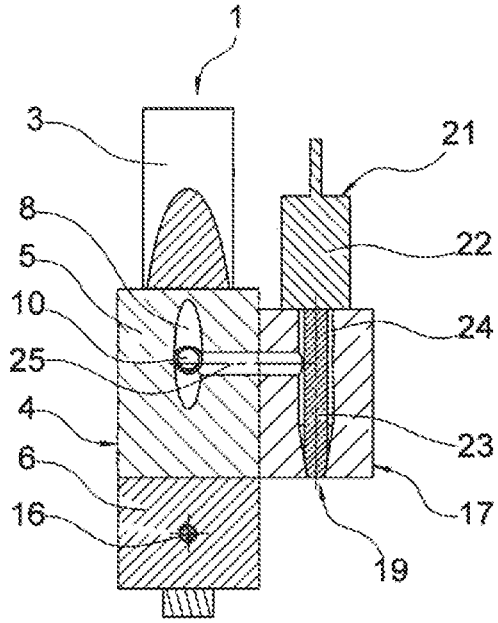
FIG. 8 shows a further schematic partial sectional view of the metering device according to FIG. 1.

Since the volumetric flow per component K1, K2 in this calibration procedure can be metered individually from the respective calibration exit 18, 19, a calibration per component K1, K2 under pressure can be performed in a very simple manner. The quantity of the component K1, K2 per unit of time is measured herein and used as a measured value of a calibration function of the metering device 1. Specifically in the case of compressible products P, or in the case of compressible components K1, K2, respectively, dissimilar flows and volumes, or masses, respectively, can arise in particular at the beginning and at the end of a metering procedure, the determination of said flows and volumes, or masses, respectively, is not able to be determined by a back pressure, that is generated by flow resistances. To this end, FIG. 7 shows the opened pressure-regulating valve 21, and FIG. 8 shows the pressure-regulating valve 21 in a closed state.

However, since the product P, or the components K1, K2, respectively, are no longer compressible as from the predetermined nominal pressure, and the compressibility becomes almost zero, this effect can be minimized in that the product pressure is always maintained in a pressure window which is larger than or equal to the nominal pressure. Should the product P, or the components K1, K2, respectively, contain fillers such as, for example, micro balloons, which could burst as from a specific pressure, the nominal pressure can be set such that the maximum possible quantity of the product P is metered on the other hand, but the bursting of the fillers is prevented by the limitation to a maximum pressure.

Figure 9:
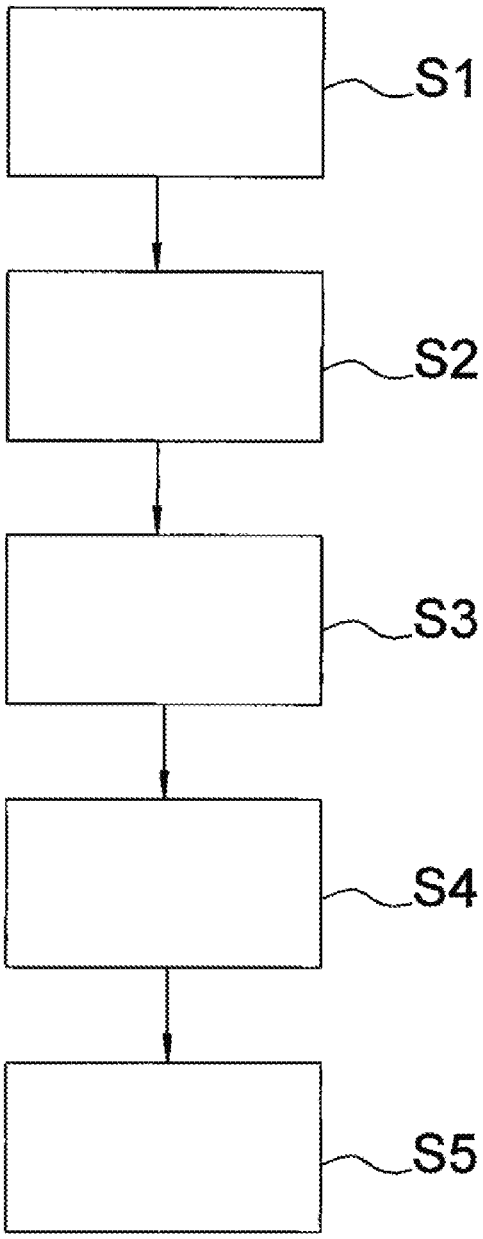
FIG. 9 shows a schematic block diagram of an embodiment of a method for operating the metering device according to FIG. 1.

A method for metering the liquid or pasty product P in a pressure-regulated manner, such as illustrated in FIG. 9, comprises a plurality of steps. In a step S1 the product P with the aid of the metering pump 2, 3 is fed in a metered manner into the mixing chamber 27. In the step S1 at least two components K1, K2 of the product P can also be fed in a metered manner from different metering pumps 2, 3 into the mixing chamber 27. The feeding in a metered manner can be performed continuously. This means that the metering pump feeds the product P in a metered manner into the mixing chamber 27 during the entire method in a step S2 the product pressure of the product P after the mixing chamber 27 is determined. To this end, the pressure sensor 36 which can be provided directly on the mixing block 26 or even on the product diversion block 30 or on the nozzle tube 29 is used.

In a step S3 a deviation of the product pressure from a predetermined nominal pressure is determined. The nominal pressure is in particular so high that the product P, or the components K1, K2, respectively, are no longer compressible as from the nominal pressure in a step S4 the pressure-regulating valve 34, provided on the exit nozzle 26 of the mixing chamber 27, is opened or closed, so as to align the product pressure with the nominal pressure or to raise said product pressure beyond the nominal pressure. In particular, the product pressure is reduced when opening the pressure-regulating valve 34, and is increased when closing the pressure-regulating valve 34.

The method can furthermore comprise a calibration step S5 in which the ducts 7, 8, that is to say the entry to the mixing chamber 27, are closed, and the product P, or the individual components K1, K2, respectively, are directed to the calibration exit 18, 19. The product pressure of the product P or of the components K1, K2 herein is determined ahead of the calibration exit 18, 19 with the aid of the respective pressure sensor 9, 10, and a deviation of the determined product pressure from the predetermined nominal pressure is determined, said nominal pressure potentially corresponding to the above-mentioned nominal pressure.

The pressure-regulating valve 20, 21 that is provided on the respective calibration exit 18, 19 herein is opened or closed in a pressure-dependent manner so as to align the product pressure with the nominal pressure, wherein the product pressure is reduced when opening the respective pressure-regulating valve 20, 21, and is increased when closing the respective pressure-regulating valve 20, 21. The calibration step S5 can be carried out separately for the dissimilar components K1, K2 of the product P. In the case of the product P having only one component K1, K2 the calibration step S5 is carried out directly for the product P. The calibration of the pump is a particular objective herein.

While the present invention has bees described by means of exemplary embodiments, said invention can be modified in many ways.

LIST OF REFERENCE SIGNS

1 Metering device
2 Metering pump
3 Metering pump
4 Throughflow block
5 Mixing head block
6 Throughflow shut-off block
7 Duct
8 Duct
9 Pressure sensor
10 Pressure sensor
11 Shut-off valve
12 Drive element
13 Valve member
14 Shut-off valve
15 Drive element
16 Valve member

17 Calibration block
18 Calibration exit
19 Calibration exit
20 Pressure-regulating valve
21 Pressure-regulating valve
22 Drive element.
23 Valve member
24 Bore
25 Bore
26 Mixing block
27 Mixing chamber
28 Exit nozzle
29 Nozzle tube
30 Product diversion block
31 Duct
32 Duct
33 Drive element
34 Pressure-regulating valve
35 Valve member
36 Pressure sensor
37 Control installation
K1 Component
K2 Component
L1 Longitudinal direction
P Product.
S1 Step
S2 Step
S3 Step
S4 Step
S5 Step

The invention claimed is:

1. A method for metering a liquid or pasty product in a pressure-regulated manner, the method comprising the following steps:

metered feeding of the product with the aid of a metering pump into a mixing chamber;

determining a product pressure of the product after the mixing chamber;

determining a deviation of the product pressure from a predetermined nominal pressure;

diverting the product along a diverted flow path through a diversion block positioned between the mixing chamber and a nozzle tube, wherein the diverted flow path of the product is different than a flow path of the product in the mixing chamber and the nozzle tube; and opening or closing in a pressure-dependent manner a pressure-regulating valve attached to the diversion block, the pressure-regulating valve configured to align the product pressure with the nominal pressure, wherein the product pressure is reduced when opening the pressure-regulating valve and is increased when closing the pressure-regulating valve, wherein the product is compressible up to the predetermined nominal pressure and incompressible at a pressure that is greater than the predetermined nominal pressure.

2. The method as claimed in claim 1, wherein at least two dissimilar components of the product are fed in a metered manner into the mixing chamber.

3. The method as claimed in claim 2, wherein the at least two components in the mixing chamber are mixed with one another with the aid of at least one of a static mixer and a dynamic mixer.

4. The method as claimed in claim 1, furthermore comprising a calibration step in which an entry of the mixing chamber is closed and the product is directed to a calibration exit, wherein a product pressure of the product ahead of the calibration exit is determined, wherein a deviation of the product pressure from a predetermined nominal pressure is determined, wherein a pressure-regulating valve that is provided on the calibration exit is opened or closed in a pressure-dependent manner, so as to align the product pressure with the nominal pressure, and wherein the product pressure is reduced when opening the pressure-regulating valve and is increased when closing the pressure-regulating valve.

5. The method as claimed in claim 4, wherein the product pressure is aligned with the nominal pressure in the calibration step.

6. The method as claimed in claim 4, wherein the calibration step is carried out separately for dissimilar components of the product.

7. The method as claimed in claim 1, wherein the diversion block is positioned between the mixing chamber and the nozzle tube so that a longitudinal axis of the diversion block is transverse to a longitudinal axis of at least one of the mixing chamber and the nozzle tube.

* * * * *